US010086613B2

(12) United States Patent
Okushima et al.

(10) Patent No.: US 10,086,613 B2
(45) Date of Patent: Oct. 2, 2018

(54) LIQUID DISCHARGE HEAD AND APPARATUS INCLUDING PLURAL RECORDING ELEMENT SUBSTRATES SUPPORTED BY PLURAL SUPPORT MEMBERS

(71) Applicant: CANON KABUSHIKI KAISHA, Tokyo (JP)

(72) Inventors: Shingo Okushima, Kawasaki (JP); Seiichiro Karita, Saitama (JP); Takatsuna Aoki, Yokohama (JP); Noriyasu Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/485,648

(22) Filed: Apr. 12, 2017

(65) Prior Publication Data

US 2017/0313076 A1 Nov. 2, 2017

(30) Foreign Application Priority Data

Apr. 28, 2016 (JP) ..... 2016-091447

(51) Int. Cl.
*B41J 2/155* (2006.01)

(52) U.S. Cl.
CPC ..... *B41J 2/155* (2013.01)

(58) Field of Classification Search
CPC .... B41J 2/155; B41J 2/14016; B41J 2/14149; B41J 2/1404; B41J 2/0458; B41J 2/14096;

(Continued)

(56) References Cited

U.S. PATENT DOCUMENTS 5,826,333 A 10/1998 Iketani et al.
5,933,163 A 8/1999 Koizumi et al.

(Continued)

FOREIGN PATENT DOCUMENTS

JP 2008-526553 A 7/2008
JP 2009-279939 A 12/2009

OTHER PUBLICATIONS

U.S. Appl. No. 15/390,847, filed Dec. 27, 2016, Shingo Okushima, Seiichiro Karita, Takatsuna Aoki, Noriyasu Nagai.

*Primary Examiner* — Juanita D Jackson
(74) *Attorney, Agent, or Firm* — Fitzpatrick, Cella, Harper & Scinto

(57) ABSTRACT

A liquid discharge head includes a first recording element substrate, a second recording element substrate, and a third recording element substrate successively arranged in a longer direction of the liquid discharge head, the first, second, and third recording element substrates each including a discharge port configured to discharge a liquid and an energy-generating element configured to generate energy used for discharging the liquid; a first support member supporting an end part of the first recording element substrate on a side of the second recording element substrate and an end part of the second recording element substrate on a side of the first recording element substrate; and a second support member supporting an end part of the second recording element substrate on a side of the third recording element substrate and an end part of the third recording element substrate on a side of the second recording element substrate.

17 Claims, 7 Drawing Sheets

(58) Field of Classification Search
CPC ... B41J 2/03; B41J 2/01; B41J 2/14056; B41J 2/072; B41J 2202/19; B41J 2202/20; B41J 2202/21; B31J 2002/022; B31J 2002/033
See application file for complete search history.

(56) References Cited

U.S. PATENT DOCUMENTS

| | | | | |
|---|---|---|---|---|
| 7,416,629 | B2 | 8/2008 | Silverbrook et al. | |
| 7,469,987 | B2 | 12/2008 | Silverbrook et al. | |
| 7,571,541 | B2 | 8/2009 | Silverbrook et al. | |
| 7,736,458 | B2 | 6/2010 | Silverbrook et al. | |
| 7,776,175 | B2 | 8/2010 | Silverbrook et al. | |
| 9,221,257 | B2 | 12/2015 | Moriya et al. | |
| 2003/0081058 | A1 * | 5/2003 | McElfresh ..... | B41J 2/14024 347/40 |
| 2006/0152557 | A1 | 7/2006 | Silverbrook et al. | |
| 2015/0197089 | A1 | 7/2015 | Karita et al. | |

* cited by examiner

LIQUID DISCHARGE HEAD AND APPARATUS INCLUDING PLURAL RECORDING ELEMENT SUBSTRATES SUPPORTED BY PLURAL SUPPORT MEMBERS

BACKGROUND OF THE INVENTION

Field of the Invention

The present invention relates to a liquid discharge head capable of discharging a liquid from discharge ports by using energy-generating elements and to a liquid discharge apparatus.

Description of the Related Art

In recent years, liquid discharge apparatuses discharging a liquid such as an ink have been used not only for home printing but also for business printing for retail photos or the like, and industrial printing such as electronic circuit printing and panel display printing, and are used in wider fields. For such liquid discharge apparatuses for business use and industrial use, a liquid discharge head enabling high speed recording is strongly demanded. To achieve this demand, it is effective to drive energy-generating elements for discharging an ink at a higher frequency or to use, as the liquid discharge head, a long body line head having a width adapted to the width of a recording medium.

To increase the width of a liquid discharge head, a plurality of recording element substrates having discharge ports and energy-generating elements are typically arranged in a longer direction. Specifically, Japanese Patent Application Laid-Open No. 2008-526553 discloses a method of arranging a plurality of recording element substrates on an integral support member. Also, Japanese Patent Application Laid-Open No. 2009-279939 discloses a method of arranging and installing, on an integral support plate, a plurality of head modules each including a recording element substrate on a support member.

When a line head has a larger dimension in the longer direction in the structure of such an integral support member as disclosed in Japanese Patent Application Laid-Open No. 2008-526553, the support member is difficult to prepare at a high geometric accuracy, and a resulting image may be distorted in the longer direction. With such a head module structure as disclosed in Japanese Patent Application Laid-Open No. 2009-279939, adjacent recording element substrates are placed on different support members at the connecting part between the adjacent recording element substrates, and thus the faces of the recording element substrates are likely to cause inclination at the connecting part. This may vary the angle of a liquid discharged from discharge ports to cause defects such as unevenness in an image at connecting parts.

In view of the above circumstances, the present invention is intended to provide a long body liquid discharge head including a plurality of arranged recording element substrates and to provide a liquid discharge apparatus, and the liquid discharge head and the liquid discharge apparatus enable recording of high quality images.

SUMMARY OF THE INVENTION

A liquid discharge head includes a first recording element substrate, a second recording element substrate, and a third recording element substrate successively arranged in a longer direction of the liquid discharge head, the first, second, and third recording element substrates each including a discharge port configured to discharge a liquid and including an energy-generating element configured to generate energy used for discharging the liquid; a first support member supporting an end part of the first recording element substrate on a side of the second recording element substrate and an end part of the second recording element substrate on a side of the first recording element substrate; and a second support member supporting an end part of the second recording element substrate on a side of the third recording element substrate and an end part of the third recording element substrate on a side of the second recording element substrate.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Liquid discharge heads and a liquid discharge apparatus pertaining to embodiments of the present invention will now be described with reference to drawings.

The liquid discharge head of the present invention that discharges a liquid such as an ink and a liquid discharge apparatus equipped with the liquid discharge head are applicable to apparatuses including printers, copying machines, facsimile machines having a communication system, and word processors having a printer unit. The liquid discharge head and the liquid discharge apparatus are also applicable to industrial recording apparatuses combined with various processors. For example, the liquid discharge head and the liquid discharge apparatus can be used to prepare biochips, to print electronic circuits, and to prepare semiconductor substrates, for example. Hence, "recording" described below is not just forming characters or images on recording media but widely includes discharging a liquid from discharge ports in order to prepare the biochip or the electronic circuit.

The embodiments described below are appropriate specific examples of the present invention and thus include technically preferred various limitations. However, the present embodiments are not intended to be limited by embodiments in the present specification or other specific methods, without departing from the idea of the present invention.

First Embodiment

Figure 1A:
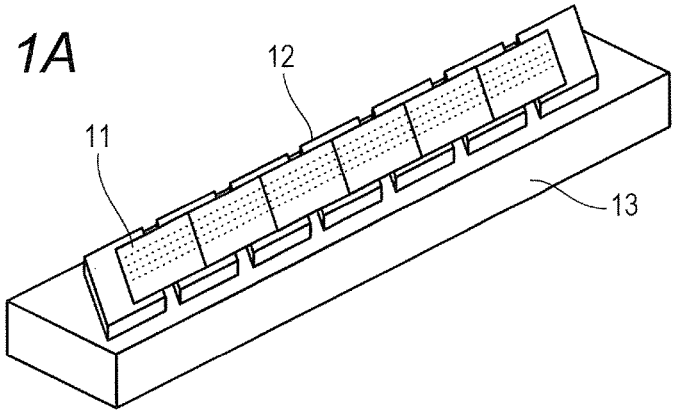
FIGS. 1A and 1B are perspective views of a liquid discharge head in a first embodiment of the present invention.
Figure 1B:
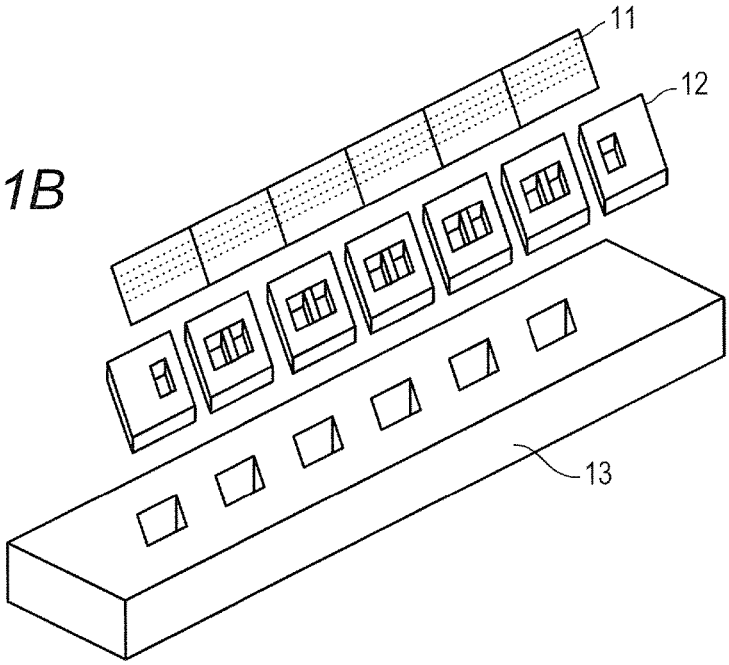
Figure 1C:
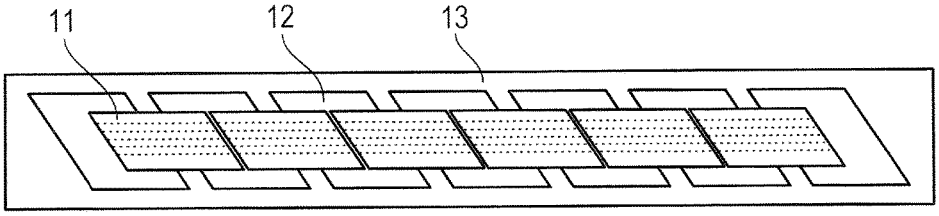
FIG. 1C is a top view of the liquid discharge head.
Figure 2A:
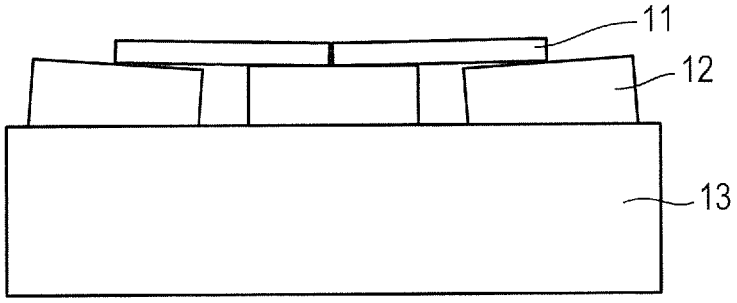
FIG. 2A is a side view of the liquid discharge head in the first embodiment.

FIGS. 1A to 1C and FIG. 2A are schematic diagrams of a liquid discharge head in a first embodiment of the present invention. FIG. 1A is a perspective view of the liquid discharge head in which recording element substrates 11 are linearly arranged in the longer direction of the liquid discharge head; FIG. 1B is an exploded perspective view of the disassembled head; and FIG. 1C is a top view of the head. FIG. 2A is a side view showing a connecting part of recording element substrates 11 in the embodiment of the present invention. The liquid discharge head in the embodiment is a page-wide (full-line) long body head having a length corresponding to a width including the width of a recording field on which recording is performed. A recording medium is conveyed in a direction crossing the longer direction of the liquid discharge head, and the liquid discharge head discharges a liquid to perform recording on the recording medium.

The liquid discharge head in the embodiment includes, as shown in FIGS. 1A to 1C, a plurality of recording element substrates 11, a plurality of support members 12, and a support plate 13. To each recording element substrate 11, energy-generating elements for generating energy to discharge a liquid such as an ink are formed, and discharge ports for discharging a liquid are formed corresponding to the respective energy-generating elements. The recording element substrate 11 includes a Si substrate having the energy-generating elements and a discharge-port-forming member having the discharge ports, which are not shown in the drawings. The recording element substrates 11 are placed on the support members 12, and the plurality of support members 12 on the top faces of which the recording element substrates 11 are placed are linearly placed on the support plate 13. In the arrangement of the recording element substrates 11, as shown in FIGS. 1A to 1C, adjacent recording element substrates are linearly arranged in such a manner as to partly overlap with each other in both the longer direction and a direction orthogonal to the longer direction (recording medium conveyance direction). In the embodiment, each recording element substrate 11 has a substantially parallelogram shape, and discharge ports are arranged in the longer direction of the liquid discharge head. A plurality of discharge port arrays are arranged in parallel with respect to a direction crossing the longer direction of the liquid discharge head. On recording element substrates 11 adjacent to each other, discharge ports in an end part of one recording element substrate 11 on the side of the other recording element substrate are arranged in such a manner as to follow discharge ports in an end part of the other recording element substrate 11 on the side of the one recording element substrate. The arrangement is not limited to this, and discharge ports in both end parts may be arranged in such a manner as to overlap with each other with respect to the arrangement direction of recording media. The application range of the present invention is not limited to such an arrangement of recording element substrates 11 in the longer direction as shown in FIGS. 1A to 1C but also includes an arrangement in which rectangular recording element substrates 11 are linearly arranged or an arrangement in which recording element substrates are arranged in a staggered manner.

The present embodiment employs the following structure so as to improve the geometric accuracy in the longer direction and to reduce the inclination of the face of a recording element substrate at a connecting part between recording element substrates. As shown in FIGS. 1A to 1C, a plurality of recording element substrates 11 are not placed on a single support member but are placed on at least two support members 12. In addition, recording element substrates 11 adjacent to each other are placed on the same support member 12. In other words, the adjacent end parts of recording element substrates 11 adjacent to each other are placed on a common support member 12. In the liquid discharge head of the embodiment, a plurality of support members 12 are placed in the longer direction of the liquid discharge head as shown in FIGS. 1A to 1C. Hence, each support member 12 can have a smaller volume and a smaller area than a single support member composed of one body (one piece) in the longer direction. In such a structure as in the present invention in which a plurality of support members are used, the geometric accuracy of each support member can be improved as compared with the case where a single, long body type support member is formed. In particular, when supply paths for supplying a liquid to each recording element substrate 11 are formed in a support member, a plurality of support members having high geometric accuracy are preferably used. When formed by molding of a resin material or the like, a plurality of support members are preferably used because the geometric accuracy is improved. Commonly, when fine supply paths are formed in a long-body support member, the support member is likely to warp by, for example, hardening shrinkage of a resin during molding, and the geometric accuracy is likely to deteriorate. Such poor geometric accuracy may reduce supply characteristics of the supply paths or may cause defects such as liquid leakage. When a member having a lower linear expansion coefficient and a higher rigidity than those of the support members 12 is used as the support plate 13, the thermal distortion in the longer direction can be reduced as compared with a support member composed of one body in the longer direction. When the plurality of support members of the present invention are used as described above, the geometric accuracy in the longer direction can be improved.

Figure 2B:
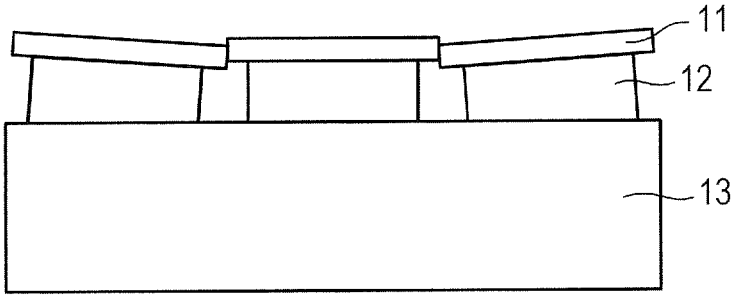
FIG. 2B is a side view of a liquid discharge head as a comparative example.

In the present embodiment, the adjacent end parts of recording element substrates 11 adjacent to each other are placed on a common support member 12 as shown in FIG. 1C and FIG. 2A. This configuration can suppress the variation in height of recording element substrates at the end parts of adjacent recording element substrates 11. This configuration can suppress the variation in height of those faces of recording element substrates 11 on which discharge ports are provided, thus can suppress the variation in flying direction or the like of discharged droplets at the connecting parts of the recording element substrates, and can suppress influence on images at the connecting parts. FIG. 2B shows a comparative example in the embodiment. FIG. 2B shows the structure in which a plurality of support members 12 are arranged on a common support plate 13. The structure differs from FIG. 2A in that the adjacent end parts of recording element substrates adjacent to each other are not placed on a common support member 12 in FIG. 2B. In the structure in FIG. 2B, the heights of discharge port faces at adjacent end parts of adjacent recording element substrates 11 are likely to vary as compared with the case of FIG. 2A, and this variation may affect image quality at the connecting parts of the recording element substrates 11. In contrast, in the structure of the present embodiment in FIG. 2A, at least some parts of recording element substrates 11 adjacent to each other are placed on different support members 12. However, the adjacent end parts of adjacent recording element substrates 11 are placed on a common support member 12, and this configuration can suppress influence on images at the connecting parts of the recording element substrates 11.

In the liquid discharge head in the embodiment, an ink is supplied through a supply path in the same support member 12 to the discharge ports in the adjacent end parts of adjacent recording element substrates 11. This configuration can reduce the difference in temperature of a liquid supplied to the discharge ports in the adjacent end parts of adjacent recording element substrates 11, and thus the variation of discharge amount at the connecting part of adjacent recording element substrates can be suppressed. In the case of such a liquid discharge head structure as shown in FIG. 2B, that is, the case in which a liquid supplied to the discharge ports in the adjacent end parts of adjacent recording element substrates 11 is supplied from different support members 12, the difference in temperature of the supplied liquid is likely to be large. This difference may cause a variation in amount of droplets discharged at the connecting parts of adjacent recording element substrates to affect image quality.

The present embodiment illustrates the liquid discharge head including six recording element substrates 11 and seven support members 12, that is, the structure in which each recording element substrate 11 is supported on two support members 12, but the present invention is not limited to this structure. The present invention can include the following structure: at least two support members are provided with respect to a plurality of, for example, six recording element substrates 11, and at least one connecting part between adjacent recording element substrates 11, the adjacent end parts of the recording element substrates adjacent to each other are supported on a common support member. Of the plurality of arranged recording element substrates 11, the recording element substrate provided at each end is supported on an end part support member.

When a plurality of support members are used as described above, the molding accuracy of support members is improved, and thus the distortion of images in the longer direction of a liquid discharge head can be suppressed. When a plurality of support members are provided and the adjacent end parts of recording element substrates adjacent to each other are placed on a common support member, the effect on images at the connecting parts between recording element substrates can be suppressed. In addition, by supplying a liquid to the discharge ports in the adjacent end parts of recording element substrates adjacent to each other through a common support member, a liquid having a small difference in temperature can be supplied, and thus the variation of discharge amount can be suppressed.

The length of each recording element substrate 11 in the longer direction of the liquid discharge head is preferably more than that of each support member. In other words, that connecting part interval between recording element substrates 11 which directly affects the arrangement position of discharge ports can be further reduced when the processing accuracy of the recording element substrates 11 is higher than the processing accuracy of the support members 12. Hence, the image quality at connecting parts can be improved.

The recording element substrates 11 and the support members 12 are preferably arranged at substantially the same interval in the longer direction of the liquid discharge head. In other words, when arranged with an equal interval, a plurality of recording element substrates 11 having the same shape and a plurality of support members 12 having the same shape can be used. On this account, to produce a liquid discharge head including a plurality of recording element substrates and a plurality of support members in the longer direction, the same members can be used to reduce the cost for design or processing.

The length of the support plate 13 in the longer direction is preferably equal to or more than the width of a recording medium. In other words, the recording element substrates 11 can be arranged in a width equal to or more than the width of a recording medium while high-quality image formation is achieved at connecting parts, and consequently a high-quality image can be formed across the width of a recording medium.

Second Embodiment

Figure 3A:
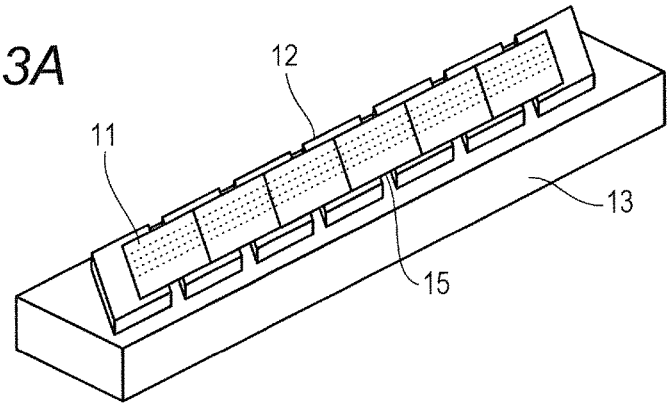
FIGS. 3A and 3B are perspective views of a liquid discharge head in a second embodiment.
Figure 3B:
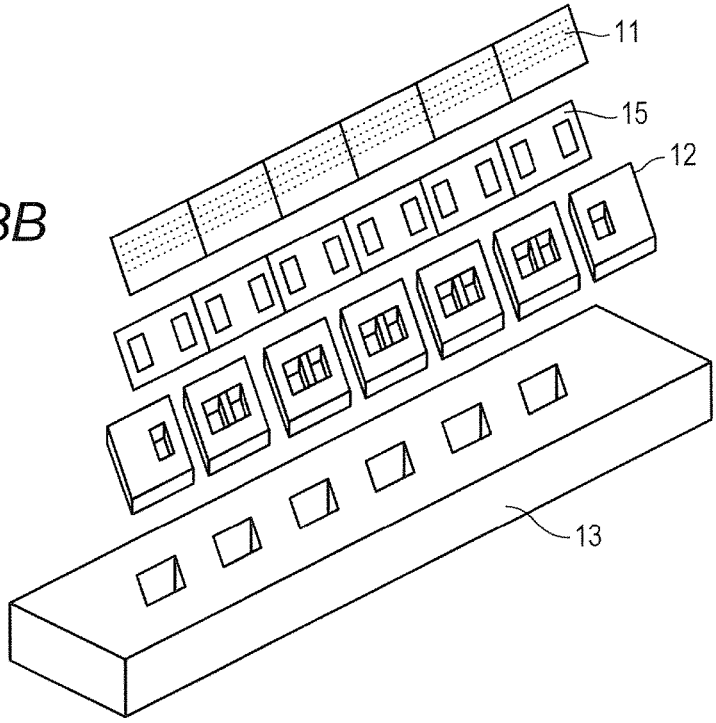
Figure 3C:
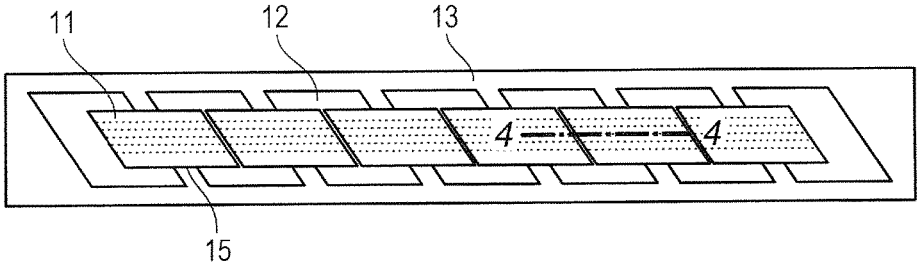
FIG. 3C is a top view of the liquid discharge head.
Figure 4:
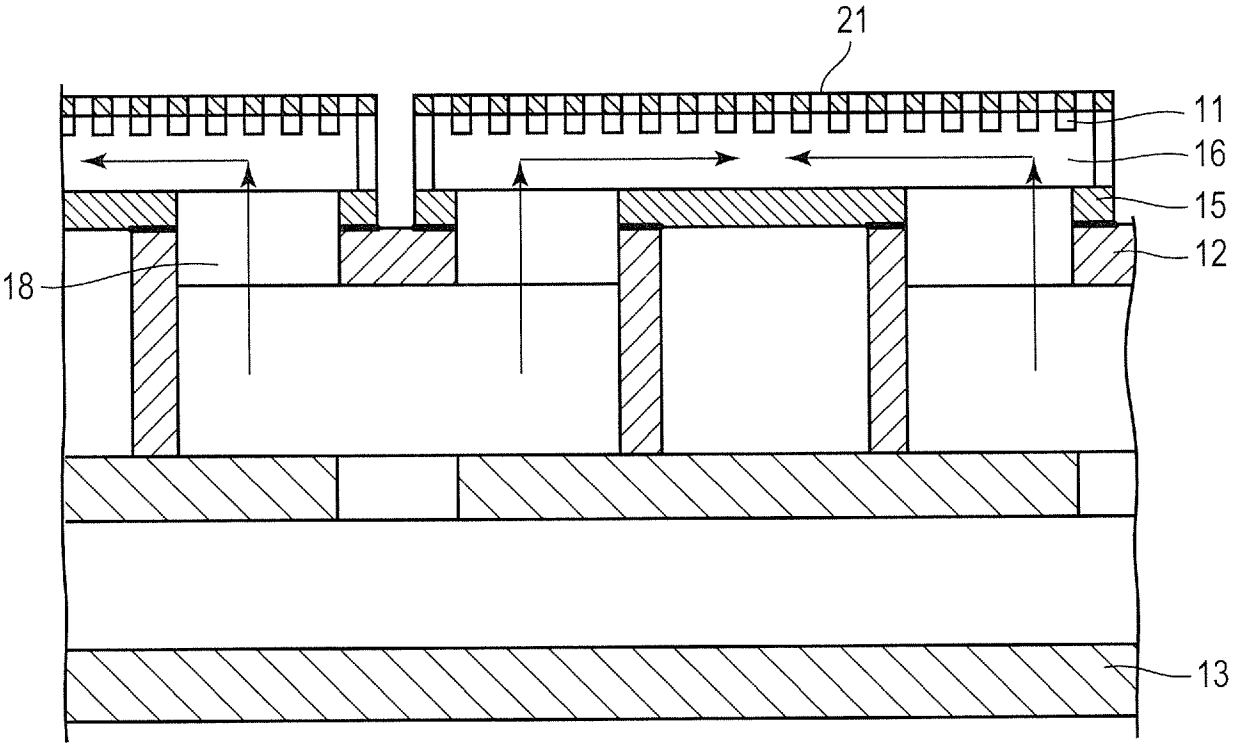
FIG. 4 is a cross-sectional view of the liquid discharge head in the second embodiment.

FIGS. 3A to 3C and FIG. 4 are schematic diagrams of a liquid discharge head in a second embodiment of the present invention, and the same members as in the above embodiment are indicated by the same signs and are not described. FIG. 3A is a perspective view of the liquid discharge head in which a plurality of recording element substrates 11 are linearly arranged in the longer direction of the liquid discharge head; FIG. 3B is an exploded perspective view of the disassembled liquid discharge head; and FIG. 3C is a top view of the liquid discharge head. FIG. 4 is a cross-sectional view taken along line 4-4 in FIG. 3C.

In the present embodiment, cover members 15 are placed on the back side of the recording element substrates 11 as shown in FIG. 3B. As shown in FIG. 4, back side supply paths 16 for supplying a liquid to be discharged from the discharge ports are provided on the back side opposite to the discharge port side of the recording element substrates 11, and the cover members 15 function as a cover for partially covering the back side supply paths 16. In addition, supply ports 18 for supplying a liquid to the back side supply paths 16 are provided in the cover members 15 and communicate with supply paths provided in the support members 12, for example.

In the embodiment, a manner of supplying a liquid from the support plate 13 to the recording element substrates 11 will be described. As shown in FIG. 4, on the long body support plate 13, a plurality of openings for supply are arranged in the longer direction, and a liquid is supplied through the openings to the support members 12. The support plate 13 has through-holes for supplying a liquid, and a liquid is supplied through the through-holes and the supply ports 18 of the cover members to the recording element substrates 11. The liquid supplied to the recording element substrates 11 is discharged from the discharge ports through the back side supply paths 16, liquid supply ports (see FIG. 5), and pressure chambers including energy-generating elements (see FIG. 5).

As shown in FIG. 4, in the present embodiment, a back side supply path 16 is also provided in a recording element substrate 11 at a position corresponding to the connecting part of adjacent support members 12, and a cover member 15 covers the back side supply path 16 at the position to form a flow path. Here, the cover member 15 is a thinner member than the support member 12 so as to be processed at substantially the same processing accuracy as the recording element substrate 11. In the present embodiment, the cover member 15 is made from a silicon substrate having a thickness of 1 mm or less. The silicon substrate can be processed by lithographic processing, blade dicing for wafer processing, or laser processing, and can be processed at substantially the same processing accuracy as that of the recording element substrate 11. The material is not limited to silicon, and alumina can be used, for example. As another example, the cover member 15 may be a resin film having a thickness of 0.1 mm or less. The resin film can also be processed by lithographic processing, blade dicing for wafer processing, or laser processing, and can be processed at substantially the same processing accuracy as that of the recording element substrate 11. The back side supply paths 16 of the recording element substrates and the supply ports 18 of the cover members 15 have fine structures, and thus the recording element substrates 11 and the cover members 15 are preferably joined without a liquid adhesive. Such joining can prevent an adhesive from entering into supply paths in the recording element substrates 11 and the cover members 15.

As described above, a cover member 15 covers a back side supply path 16 at the connecting part between support members 12 to form a flow path. With such a structure, a liquid can also be supplied, through the back side supply path 16 provided on the back side of the recording element substrate 11, to the discharge ports 21 at a position that is the connecting part between support members 12 and is a space behind the recording element substrate 11. In other words, in the liquid discharge head according to the first embodiment which improves the geometric accuracy in the longer direction, reduces the inclination of the substrate face at the connecting part between element substrates, and reduces the temperature difference, discharge ports 21 can also be provided at the connecting parts between the support members 12. In addition, the discharge ports can be continuously arranged without gaps in the longer direction. Consequently, an image without gaps in the longer direction can be formed.

Also in the first embodiment, a flow path can be formed on the discharge port formation face of the recording element substrate 11 to supply a liquid to discharge ports 21 in a position protruding outward from the end part of the support member 12. Unfortunately, the height of a flow path capable of being formed on the discharge port formation face is typically several tens of micrometers, whereas the height of a flow path capable of being formed on the back side is several hundred micrometers, and the pressure loss can be reduced. Accordingly, a sufficient liquid can be supplied to the discharge ports in the end parts in the present embodiment. Hence, the present embodiment enables the formation of a higher-quality image at connecting parts. In the present invention, the recording element substrate 11 may be formed by laminating a plurality of layers to form back side supply paths. Similarly, the support member 12 and the support plate 13 may also be formed of laminates. As shown in FIG. 3B and FIG. 4, the distance between support members 12 adjacent to each other is more than the distance between cover members 15 adjacent to each other.

Third Embodiment

Figure 5:
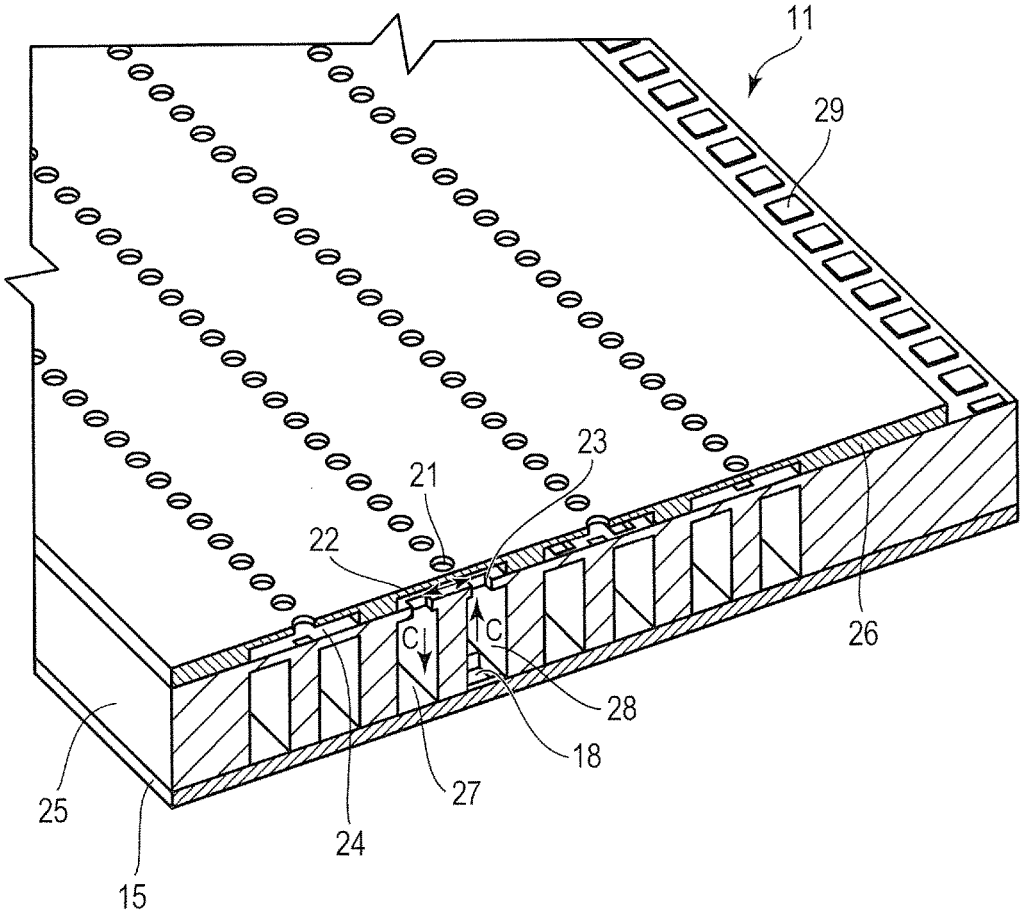
FIG. 5 is a cross-sectional perspective view of a liquid discharge head in a third embodiment.

FIG. 5 is a cross-sectional perspective view of a liquid discharge head as a third embodiment of the present invention. The present embodiment relates to a liquid discharge head including a flow path structure in which a liquid is circulated between a pressure chamber including an energy-generating element and the outside of the pressure chamber. FIG. 5 is a schematic perspective view for explaining the embodiment and is a cross-sectional perspective view taken along a shorter direction of a recording element substrate 11. The figure shows only a recording element substrate 11 and a cover member 15 to facilitate the explanation, but the liquid discharge head in the embodiment is a liquid discharge head further including support members 12 and a support plate 13 as with the above embodiments.

As shown in FIG. 5, the recording element substrate 11 includes a substrate 25 and a discharge port forming member 26. The substrate 25 includes pressure chambers 24 including energy-generating elements configured to generate energy used for discharging a liquid. The recording element substrate 11 further includes liquid supply ports 23 as through-holes for supplying a liquid to the pressure chambers 24 and liquid collection ports 22 as through-holes for collecting the liquid that lies within the pressure chambers 24 and is not discharged. In the above embodiments, the substrate 25 includes the back side supply paths 16. In the present embodiment, each back side supply path includes a liquid supply path 28 and a liquid collection path 27. In other words, the substrate 25 includes liquid supply paths 28 for supplying a liquid supplied from a support member through the cover member to the supply ports 23 and liquid collection paths 27 for collecting the liquid collected from the pressure chambers 24 to the liquid collection ports 22, through the cover member 15 to the support member side. Each of the liquid supply paths 28 and the liquid collection paths 27 extends in parallel along the arrangement direction of the discharge ports. On the recording element substrate 11, a plurality of terminals 29 are provided along the extending direction of the discharge port arrays and are electrically connected to a liquid discharge apparatus through a flexible wiring board not shown in the drawings.

The cover member 15 functions as a cover partly forming the walls of the liquid supply paths 28 and the liquid collection paths 27 formed in the substrate 25 (Si substrate) included in the recording element substrate 11. The cover member 15 is preferably made of a material having sufficient corrosion resistance to a liquid, and the opening shape and position of the supply port 18 are required to have high accuracy to prevent liquids from mixing. The material of the cover member 15 is thus preferably a photosensitive resin material or a silicon plate, and the supply ports 18 are preferably formed by photolithographic process. As described above, the cover member changes the size of flow paths through the supply ports 18, preferably has a small thickness in terms of pressure loss, and is preferably formed of a film-shaped member.

In the liquid discharge head in the embodiment, a liquid around inactive discharge ports flows (circulates) in the following manner while the liquid is discharged from a plurality of discharge ports 21 of the liquid discharge head. In other words, the liquid in a liquid supply path 28 provided in the substrate 25 flows through the liquid supply port 23, the pressure chamber 24, and the liquid collection port 22 to the liquid collection path 27 (the flow indicated by the arrow C in FIG. 5). Due to this flow, a liquid having a viscosity increased by evaporation from discharge ports 21, bubbles, foreign substances, or the like can be collected to the liquid collection path 27 from discharge ports 21 and pressure chambers 24 where recording is stopped. This collection enables the suppression of an increase in viscosity of a liquid in discharge ports 21 or pressure chambers 24. The liquid collected to the liquid collection path 27 is collected through the supply port 18 of the cover member 15 and communication ports of the support member 12 (see FIG. 4) and is finally collected to a supply path of the main body of a liquid discharge apparatus.

Figure 6:
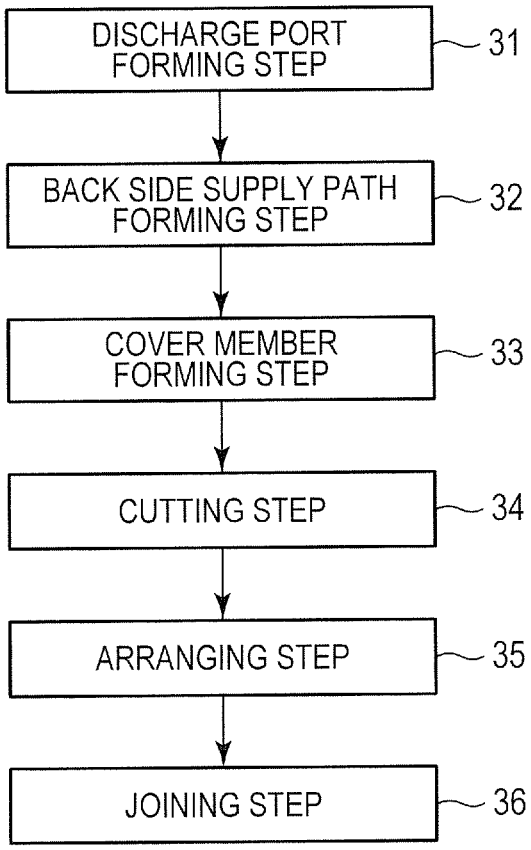
FIG. 6 is a flow chart of a production process of the second embodiment.

Next, a method for producing the liquid discharge head of the present invention will be described. FIG. 6 is a flow chart of a production process of the liquid discharge head described in the second embodiment. In FIG. 6, step 31 is a discharge port forming step of forming discharge ports on a substrate (Si substrate) included in a recording element substrate 11 in which energy-generating elements, an integrated circuit, and the like have been formed; and step 32 is a back side supply path forming step of forming back side supply paths 16 on the back side of the recording element substrate 11. Step 33 is a cover member forming step of forming a cover member 15 on the back side of the recording element substrate 11 in which the back side supply paths have been formed; and step 34 is a cutting step of processing the outer shape of the recording element substrate 11 on a wafer into individual recording element substrates 11 by dicing, for example. Step 35 is an arranging step of arranging a plurality of support members 12 on a long body support plate 13; and step 36 is a joining step of joining the recording element substrates 11 onto support members 12.

By performing the cover member forming step 33 to form the cover member 15 on the back side of the recording element substrate 11 before the joining step 36 as described above, the structure described in the second embodiment can be produced. Through the cover member forming step 33, a liquid discharge head which can improve the geometric accuracy in the longer direction, reduce the inclination of the substrate face at the connecting part between element substrates, and reduce the temperature difference can be produced. With such a liquid discharge head, defects such as the distortion of an image in the longer direction and unevenness in an image at connecting parts are suppressed, and a high-quality image can be formed. When the cover member 15 is formed of a silicon substrate, the cover member 15 formed of a silicon substrate in a wafer shape can be joined to a recording element substrate 11 in a wafer shape, thus the process can be simplified, and such a cover member is preferred. When the cover member 15 is a resin film, the cover member 15 can be joined by laminating the film-shaped resin to a recording element substrate 11 in a wafer shape as with the cover member formed of a silicon substrate, and thus such a cover member is also preferred. The process sequence and the process contents described in the present example are merely examples and are not intended to limit the present invention. In other words, the order of the discharge port forming step, the back side supply path forming step, the cover member forming step, and the cutting step is not intended to limit the present invention, and it is sufficient to perform the cover member forming step 33 before the joining step 36.

Figure 7:
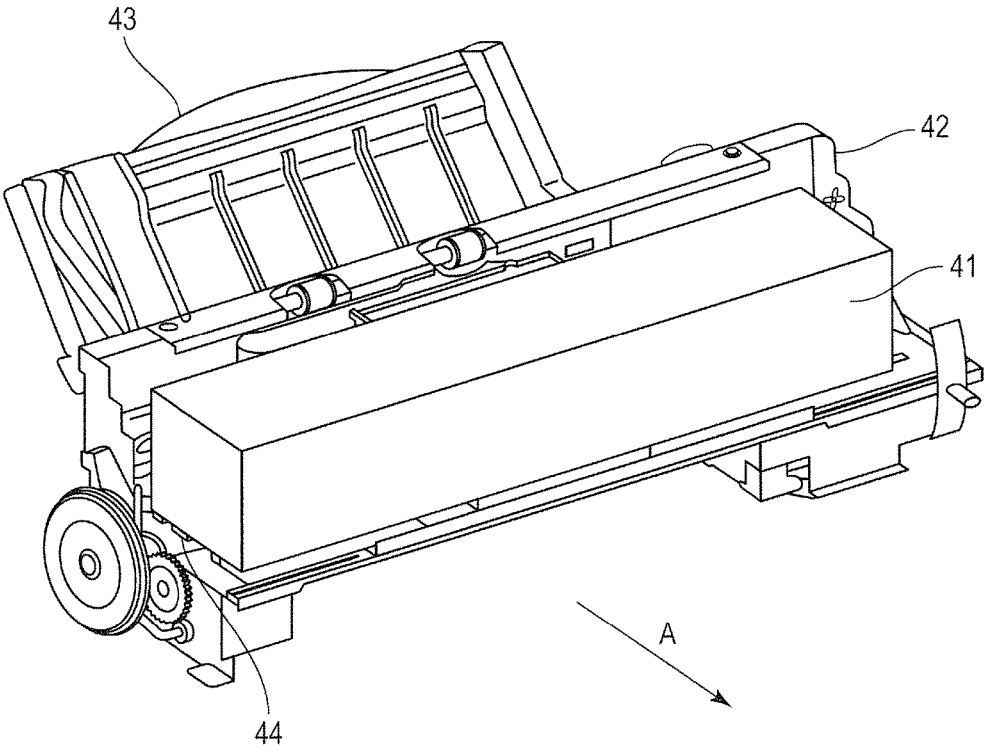
FIG. 7 is a schematic perspective view of a liquid discharge apparatus to which the present invention is applicable.

FIG. 7 is a schematic perspective view of a liquid discharge apparatus to which the liquid discharge head of each embodiment is applicable. In FIG. 7, the numeral 41 represents the liquid discharge head described in the first to third embodiments. The numeral 42 represents a chassis made of a plurality of plate-shaped metal members having a certain rigidity and constitutes the skeleton of the liquid discharge apparatus. The chassis 42 is equipped with a medium feeding unit 43, a medium conveying unit 44, and the above liquid discharge head 41. The medium feeding unit 43 automatically feeds a sheet-shaped recording medium not shown in the drawings to the inside of the liquid discharge apparatus. The medium conveying unit 44 introduces a recording medium fed from the medium feeding unit 43 to an intended recording position along the arrow A direction. To the liquid discharge head 41, a liquid is supplied from a liquid tank not shown in the drawings. The figure shows an embodiment in which the head is fixed to the apparatus, but a head itself may be scanned in another embodiment. As described above, the liquid discharge apparatus of the embodiment can use the above liquid discharge head to perform recording on a recording medium. In other words, the liquid discharge apparatus improves the geometric accuracy in the longer direction of the liquid discharge head, reduces the inclination of the substrate face at the connecting part between element substrates, reduces the temperature difference, and enables the formation of a high-quality image.

Hereinbefore, the embodiments to which the present invention is applicable have been described, but the invention includes not only the embodiment in which a plurality of recording element substrates are linearly arranged as described above but also an embodiment in which recording element substrates are arranged in a staggered manner. An embodiment to which the present invention is applicable will next be described. To facilitate the explanation, an embodiment including three, i.e. first, second, and third recording element substrates will be described.

In a prescribed direction, here, in the longer direction of a support plate 13, the first, second, and third recording element substrates are arranged in this order. A first support member supporting one end side of the first recording element substrate and one end side of the second recording element substrate and a second support member supporting the other end side of the second recording element substrate and one end side of the third recording element substrate are provided. In other words, the adjacent end parts of the first and second recording element substrates are supported on the first support member, and the adjacent end parts of the second and third recording element substrates are supported on the second support member. By placing the adjacent end parts of recording element substrates adjacent to each other on a common support member in this manner, the discharging directions can be prevented from varying at the connecting part between recording element substrates.

In addition, the first support member includes a first opening fluidly communicating with the first recording element substrate and a second opening fluidly communicating with the second recording element substrate. The second support member includes a third opening fluidly communicating with the second recording element substrate and a fourth opening fluidly communicating with the third recording element substrate.

According to the present invention, the long body liquid discharge head in which a plurality of element substrates are arranged can suppress defects such as the distortion of an image in the longer direction and unevenness of an image at the connecting parts of element substrates, and enables the formation of a high-quality image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-091447, filed Apr. 28, 2016, which is hereby incorporated by reference herein in its entirety.

What is claimed is:

1. A liquid discharge head comprising:

a first recording element substrate, a second recording element substrate, and a third recording element substrate successively arranged in a longer direction of the liquid discharge head, the first, second, and third recording element substrates each including a discharge port configured to discharge a liquid and an energy-generating element configured to generate energy used for discharging the liquid;

a first support member supporting an end part of the first recording element substrate on a side of the second recording element substrate and an end part of the second recording element substrate on a side of the first recording element substrate; and a second support member supporting an end part of the second recording element substrate on a side of the third recording element substrate and an end part of the third recording element substrate on a side of the second recording element substrate; and wherein the first support member includes a first opening fluidly communicating with the first recording element substrate and a second opening fluidly communicating with the second recording element substrate, and the second support member includes a third opening fluidly communicating with the second recording element substrate and a fourth opening fluidly communicating with the third recording element substrate.

2. The liquid discharge head according to claim 1, further comprising a support plate supporting the first and second support members.

3. The liquid discharge head according to claim 1, wherein the first, second, and third recording element substrates are linearly arranged.

4. The liquid discharge head according to claim 1, wherein the second recording element substrate includes a flow path communicating with the second opening and the third opening.

5. The liquid discharge head according to claim 4, further comprising a cover member on the face of the second recording element substrate which is opposite to the face of the second recording element substrate on which the discharge port is provided, the cover member forming part of a wall of the flow path.

6. The liquid discharge head according to claim 5, wherein the cover member has a thickness less than the thickness of the first support member and than the thickness of the second support member.

7. The liquid discharge head according to claim 5, wherein the cover member has a thickness of 0.1 mm or less.

8. The liquid discharge head according to claim 5, wherein the cover member is formed of a silicon substrate.

9. The liquid discharge head according to claim 5, wherein the cover member is formed of a resin film.

10. The liquid discharge head according to claim 1, wherein the liquid discharge head is a page-wide liquid discharge head in which a plurality of recording element substrates including the first, second, and third recording element substrates are arranged.

11. The liquid discharge head according to claim 1, wherein the first support member is spaced from the second support member.

12. The liquid discharge head according to claim 1, further comprising a pressure chamber containing the energy-generating element, wherein a liquid in the pressure chamber is circulated between the pressure chamber and an outside of the pressure chamber.

13. A liquid discharge head comprising:

a first recording element substrate, a second recording element substrate, and a third recording element substrate successively arranged in a longer direction of the liquid discharge head, the first, second, and third recording element substrates each including a discharge port configured to discharge a liquid and an energy-generating element configured to generate energy used for discharging the liquid;

a first support member supporting an end part of the first recording element substrate on a side of the second recording element substrate and an end part of the second recording element substrate on a side of the first recording element substrate;

a second support member supporting an end part of the second recording element substrate on a side of the third recording element substrate and an end part of the third recording element substrate on a side of the second recording element substrate; and a first and end part support member supporting an end part of the first recording element substrate which is opposite to the end part of the first recording element substrate which is on the side of the second recording element substrate, wherein the first end part support member includes an opening fluidly communicating with the first recording element substrate.

14. A liquid discharge head comprising:

a first recording element substrate, a second recording element substrate, and a third recording element substrate successively arranged in a longer direction of the liquid discharge head, the first, second, and third recording element substrates each including a discharge port configured to discharge a liquid and an energy-generating element configured to generate energy used for discharging the liquid;

a first support member supporting an end part of the first recording element substrate on a side of the second recording element substrate and an end part of the second recording element substrate on a side of the first recording element substrate; and a second support member supporting an end part of the second recording element substrate on a side of the third recording element substrate and an end part of the third recording element substrate on a side of the second recording element substrate, wherein the first, second, and third recording element substrates are linearly arranged in a prescribed direction, and a length of the second recording element substrate in the prescribed direction is longer than a length of the first support member in the prescribed direction.

15. A liquid discharge head comprising:

a first recording element substrate, a second recording element substrate, and a third recording element substrate successively arranged in a longer direction of the liquid discharge head, the first, second, and third recording element substrates each including a discharge port configured to discharge a liquid and an energy-generating element configured to generate energy used for discharging the liquid;

a first support member supporting an end part of the first recording element substrate on a side of the second recording element substrate and an end part of the second recording element substrate on a side of the first recording element substrate; and a second support member supporting an end part of the second recording element substrate on a side of the third recording element substrate and an end part of the third recording element substrate on a side of the second recording element substrate, wherein a cover member forming part of a wall of a flow path is provided on a face of each of the first, second, and third recording element substrates which is opposite to a face of each of the first, second, and third recording element substrates on which the discharge port is provided.

16. The liquid discharge head according to claim 15, wherein a distance between the first support member and the second support member is longer than a distance between the cover members which are adjacent to each other.

17. A liquid discharge apparatus comprising a liquid discharge head and a conveyer configured to convey a recording medium, the liquid discharge head including:

a first recording element substrate, a second recording element substrate, and a third recording element substrate successively arranged in a longer direction of the liquid discharge head, the first, second, and third recording element substrates each including a discharge port configured to discharge a liquid and an energy-generating element configured to generate energy used for discharging the liquid;

a first support member supporting an end part of the first recording element substrate on a side of the second recording element substrate and an end part of the second recording element substrate on a side of the first recording element substrate; and a second support member supporting an end part of the second recording element substrate on a side of the third recording element substrate and an end part of the third recording element substrate on a side of the second recording element substrate, wherein the first support member includes a first opening fluidly communicating with the first recording element substrate and a second opening fluidly communicating with the second recording element substrate, and the second support member includes a third opening fluidly communicating with the second recording element substrate and a fourth opening fluidly communicating with the third recording element substrate.

* * * * *